US012478890B2

(12) United States Patent
Davis et al.

(10) Patent No.: US 12,478,890 B2
(45) Date of Patent: Nov. 25, 2025

(54) STACKABLE NESTING DOLLHOUSE

(71) Applicant: Milliard IP, LLC, Lakewood, NJ (US)

(72) Inventors: Esther Davis, Lakewood, NJ (US); Tzippora Niasoff, Lakewood, NJ (US)

(73) Assignee: Milliard IP, LLC, Lakewood, NJ (US)

( * ) Notice: Subject to any disclaimer, the term of this patent is extended or adjusted under 35 U.S.C. 154(b) by 176 days.

(21) Appl. No.: 18/520,516

(22) Filed: Nov. 27, 2023

(65) Prior Publication Data

US 2024/0173635 A1 May 30, 2024

Related U.S. Application Data

(60) Provisional application No. 63/385,027, filed on Nov. 27, 2022.

(51) Int. Cl.
*A63H 3/52* (2022.01)

(52) U.S. Cl.
CPC ..... *A63H 3/52* (2013.01)

(58) Field of Classification Search
CPC ..... A63H 3/52; A63H 33/008; A63H 33/044
See application file for complete search history.

(56) References Cited

U.S. PATENT DOCUMENTS 2,544,833 A * 3/1951 Hammond ..... A63H 3/52 446/109
3,400,485 A * 9/1968 Callin ..... A63H 3/52 446/76
3,930,699 A * 1/1976 Schnizlein, Jr. ..... A63H 3/52 206/505
6,520,831 B1 * 2/2003 Craig ..... A63H 3/52 446/105
6,565,413 B2 * 5/2003 Brownrigg ..... A63H 3/52 446/476
6,926,020 B2 * 8/2005 Zheng ..... A63B 9/00 135/117
8,621,739 B1 * 1/2014 Elliot ..... A63H 33/084 29/428
2021/0008462 A1 * 1/2021 Lipschitz ..... A63H 3/52

* cited by examiner

*Primary Examiner* — John A Ricci
(74) *Attorney, Agent, or Firm* — Coffield Heedy Kilgore PLLC; William Heedy

(57) ABSTRACT

A stackable nesting dollhouse includes a first component, a second component, and a third component. The first component includes a first upper wall, a first lower wall, a first left wall, and a first right wall, wherein the first upper wall may be located lower than the plane formed by the first left wall, the first rear wall, and the first right wall, creating a first offset. The second component includes a second upper wall, a second lower wall, a second left wall, and a second right wall, wherein the second upper wall may be located lower than the plane formed by the second left wall, the second rear wall, and second right wall, creating a second offset, wherein the second component is sized to be stacked on or nested within the first component. The third component is sized to be stacked on or nested within the second component.

2 Claims, 14 Drawing Sheets

STACKABLE NESTING DOLLHOUSE

CROSS REFERENCE TO RELATED APPLICATION

The present application claims the priority of U.S. Provisional Patent Application Ser. No. 63/385,027 filed Nov. 27, 2022, entitled "STACKABLE NESTING DOLLHOUSE", which is incorporated herein in its entirety.

FIELD OF THE INVENTION

This invention relates to a stackable nesting dollhouse, and, more particularly, to a nesting dollhouse capable of being deployed in a stacked configuration or stored in a nested configuration with individual components being stored in a single, outer component.

BACKGROUND OF THE INVENTION

Dollhouses are generally miniaturized versions of homes or buildings, and they are widely used as children's toys. Dollhouses come in many varieties with scales ranging from 1:6 to 1:144 of a regularly-sized home or building.

Dollhouses designs are generally limited to a fixed, static configuration in which the dollhouse is composed of a single, unitary construction. Given the relative scaled sizing of dollhouses, such dollhouses may generally range from a small, tabletop size to a larger, child-size structure.

Most dollhouses are available in a single configuration, where the size of the dollhouse may occupy a substantial portion of a room. Similarly, the single configuration prevents them from being disguised or camouflaged into, for example, a room's surroundings when not in use.

Therefore, there exists the need for a dollhouse design that is capable of being collapsed into a smaller structure for storage purposes, while remaining sturdy and resilient when in a stacked configuration. Furthermore, there exists the need for a self-contained storage solution for retaining the dollhouse components when in a stored configuration, such that the storage solution allows for storage in a small, contained capsule.

SUMMARY OF THE INVENTION

In accordance with one form of this invention, there is provided a stackable nesting dollhouse. The stackable nesting dollhouse includes a first component, a second component, and a third component. The first component includes a plurality of first planar sidewalls extending orthogonally from a plane formed by a first planar rear wall, wherein the plurality of first planar side walls include a first upper wall, a first lower wall, a first left wall, and a first right wall, wherein the first upper wall may be located lower than the plane formed by the intersection of the plane of the first left wall, the plane of the first rear wall, and the plane of the first right wall, resulting in a first offset. The second component includes a plurality of second planar sidewalls extending orthogonally from a plane formed by a second planar rear wall, wherein the plurality of second planar sidewalls include a second upper wall, a second lower wall, a second left wall, and a second right wall, wherein the second upper wall may be located lower than the plane formed by the intersection of the plane of the second left wall, the plane of the second rear wall, and the plane of the second right wall, resulting in a second offset. The third component includes a plurality of third planar sidewalls extending orthogonally from a plane formed by a third planar rear wall, wherein the plurality of third planar sidewalls includes a third left wall, third right wall, third left angled wall, third right angled wall, third lower wall, and third upper wall. The first component being configured such that the first component has an interior length (L1), an interior height (H1), and an interior width (W1); the first component further including an exterior length (TL1), an exterior height (TH1), and an exterior width (TW1). The nesting dollhouse further includes the second component configured such that the second component has an interior length (L2), an interior height (H2), and an interior width (W2); the second component further including an exterior length (TL2), an exterior height (TH2), and an exterior width (TW2). The third component being configured such that the third component has an exterior length (L3), an exterior height (H3), and an exterior width (W3). The first component and the second component have a defined dimensional relationship, the defined dimensional relationship being: TL2 is less than or approximately equal to L1; TH2 is less than or approximately equal to H1; and TW2 is less than or approximately equal to W2. The second component and the third component have a defined dimensional relationship, the defined dimensional relationship being: L3 is less than or approximately equal to L2; H3 is less than or approximately equal to H2; and W3 is less than or approximately equal to W2.

In accordance with one form of the invention, there is provided a stackable nesting dollhouse including a plurality of components. The stackable nesting dollhouse includes a first component ($C_{First}$), a plurality of intermediate components ($C_n$), and a final component ($C_{Final}$), wherein the intermediate components are sized to nest within one another and within the first component, and the final component being sized to nest within the intermediate components. The first component ($C_{First}$) including a plurality of first planar sidewalls extending orthogonally from a plane formed by the first planar rear wall, wherein the plurality of first planar side walls include a first upper wall, a first lower wall, a first left wall, and a first right wall, wherein the first upper wall is located lower than the plane formed by the intersection of the plane of the first left wall, the plane of the first rear wall, and the plane of the first right wall, resulting in a first offset. The intermediate components ($C_n$) each including a plurality of n-planar sidewalls, including a n-upper wall, a n-lower wall, a n-left wall, and a n-right wall, wherein the n-upper wall is located lower than the plane formed by the intersection of the plane of the n-left wall, the plane of the n-rear wall, and the plane of the n-right wall, resulting in a n-offset. The first component ($C_{First}$) having an interior length (L-First), an interior height (H-First), an interior width (W-First), an exterior length (TL-First), an exterior height (TH-First), and an exterior width (TW-First). The intermediate components, $C_n$, having $C_n$ dimensions including an interior length (Ln), an interior height (Hn), an interior width (Wn), an exterior length (TLn), an exterior height (THn), and an exterior width (TWn). The final component, $C_{Final}$, having a width (W-Final), a height (H-Final), and a length (L-Final). The intermediate components, $C_n$, having a dimensional relationship such that each $C_n$ dimension is greater than or approximately equal to each corresponding dimension for $C_{n+1}$, and the intermediate components. $C_n$, further having a dimensional relationship such that each $C_n$ dimension is less than or approximately equal to each corresponding dimension for $C_{n-1}$.

BRIEF DESCRIPTION OF THE DRAWINGS

For a fuller understanding of the nature of the present invention, reference should be made to the following detailed description, taken in conjunction with the accompanying drawings in which.

Like reference numerals refer to like reference parts throughout the several views of the drawings.

DETAILED DESCRIPTION

Referring to the several views of the drawings, the stackable nesting dollhouse 100 is shown and described herein.

Figure 4:
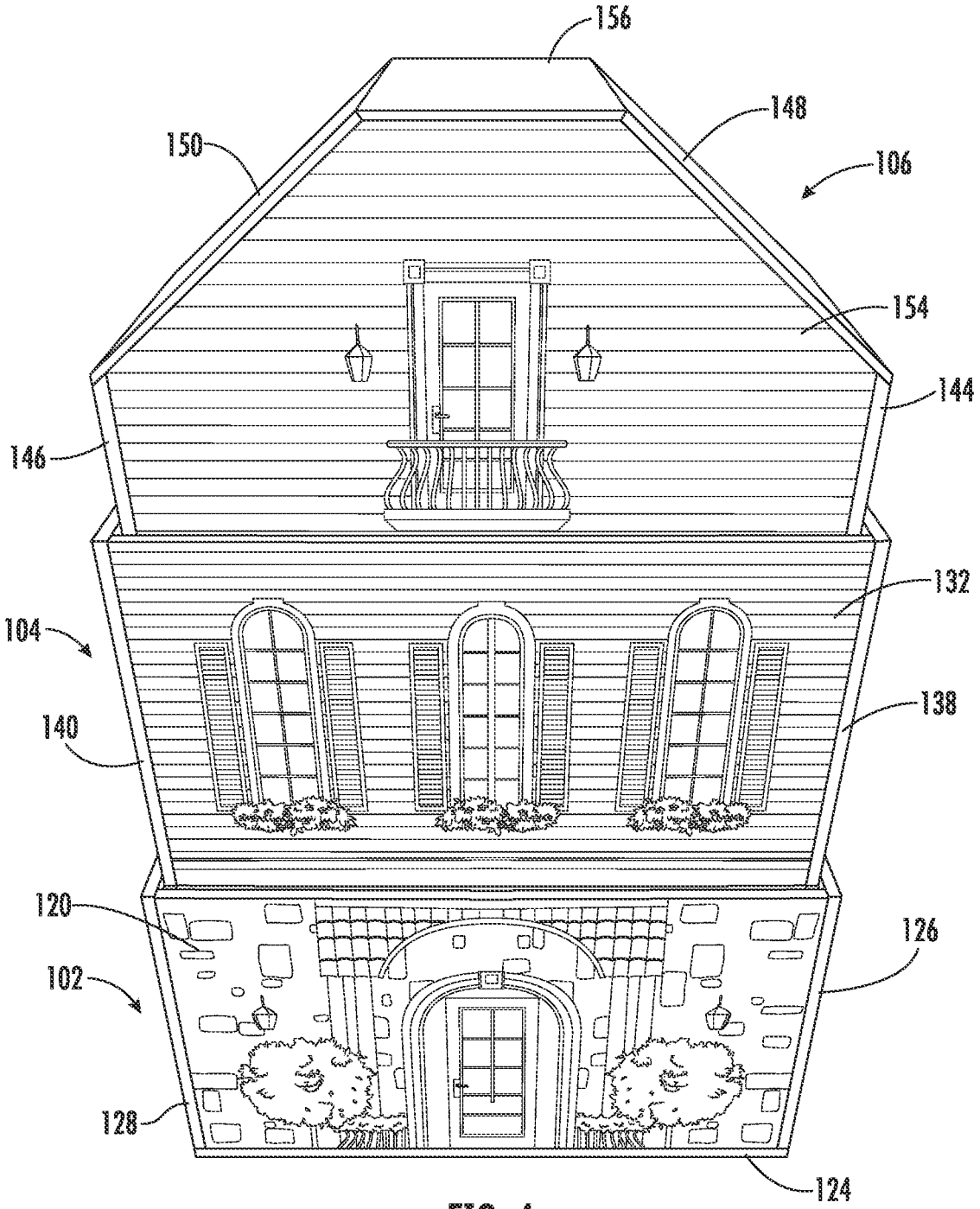
FIG. 4 is a rear view of a stackable nesting dollhouse in accordance with one embodiment.

Referring initially to FIG. 4, the stackable nesting dollhouse 100 is shown in a stacked configuration, with the first component 102, second component 104, and third component 106 being shown in a stacked arrangement. According to one embodiment, the first component 102 may be positioned in the bottommost position of the stacked arrangement, with the second component 104 located atop the first component 102, and the third component 106 located atop the second component 104. Although three components are shown in this embodiment, it will be appreciated by one of ordinary skill in the art that more or less than three components may be utilized in accordance with the teachings of this invention and without departing from the spirit or objectives of the invention.

Figure 1:
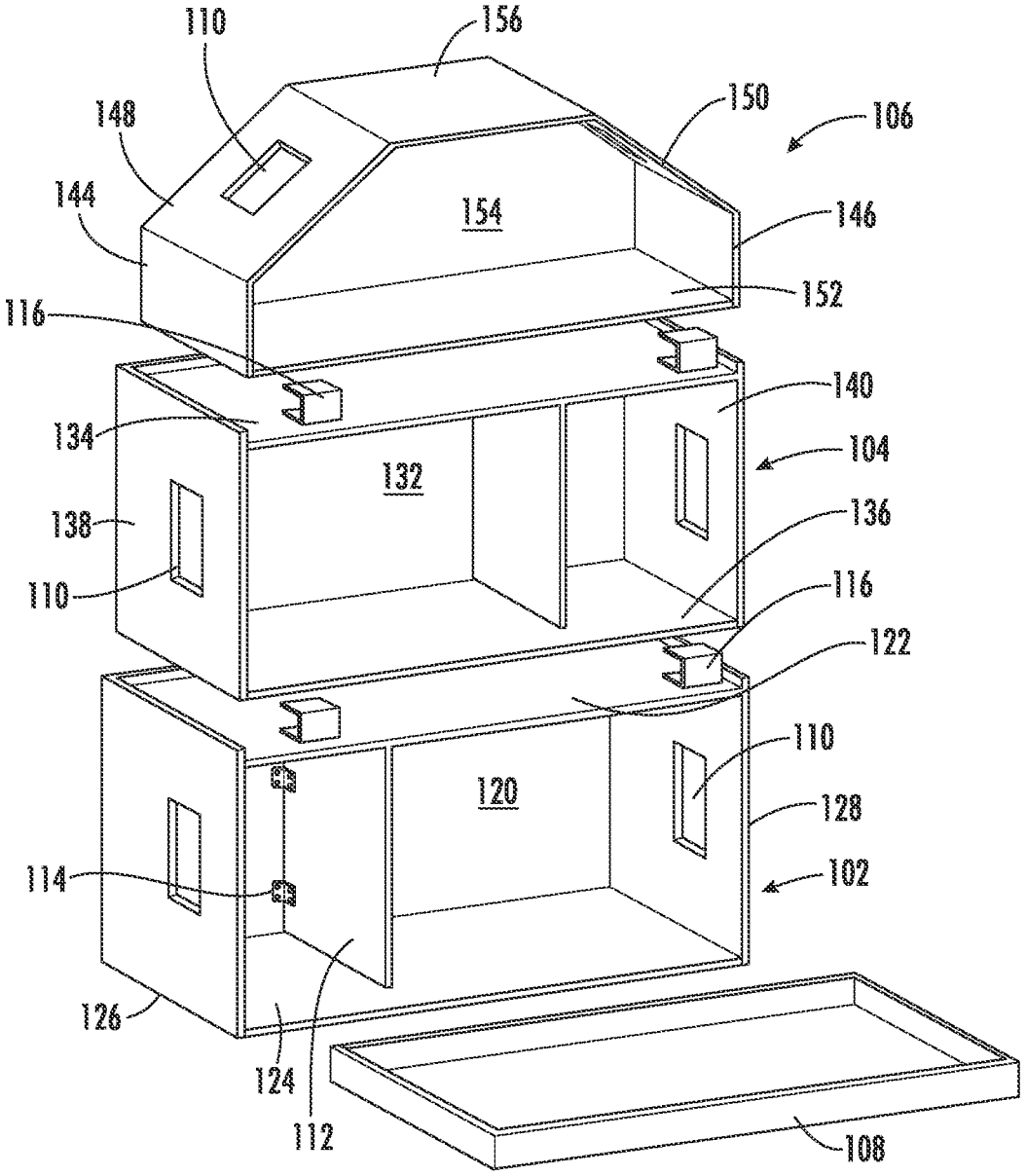
FIG. 1 is an exploded perspective view of a stackable nesting dollhouse in accordance with one embodiment.
Figure 2:
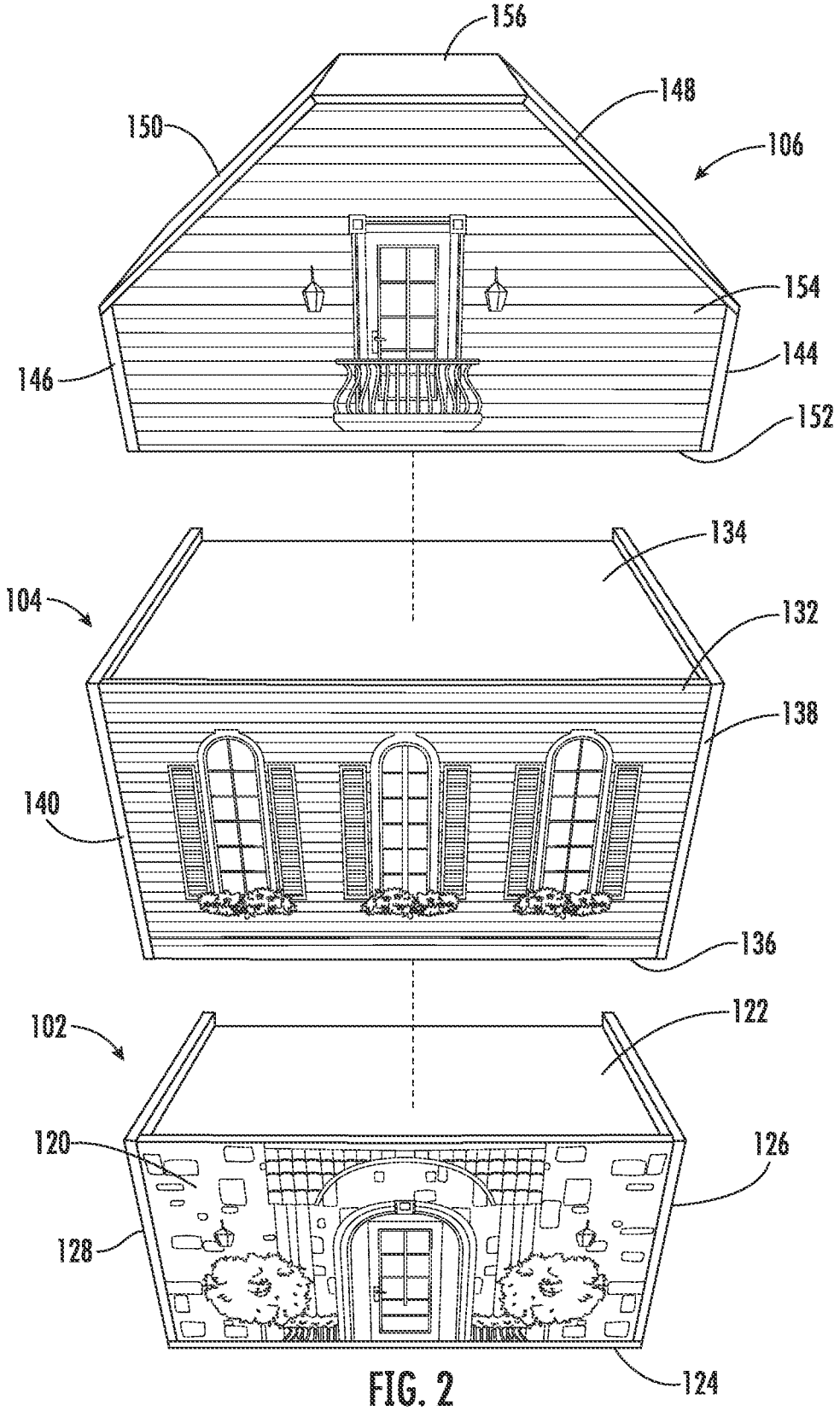
FIG. 2 is an exploded rear view of a stackable nesting dollhouse in accordance with one embodiment.
Figure 3:
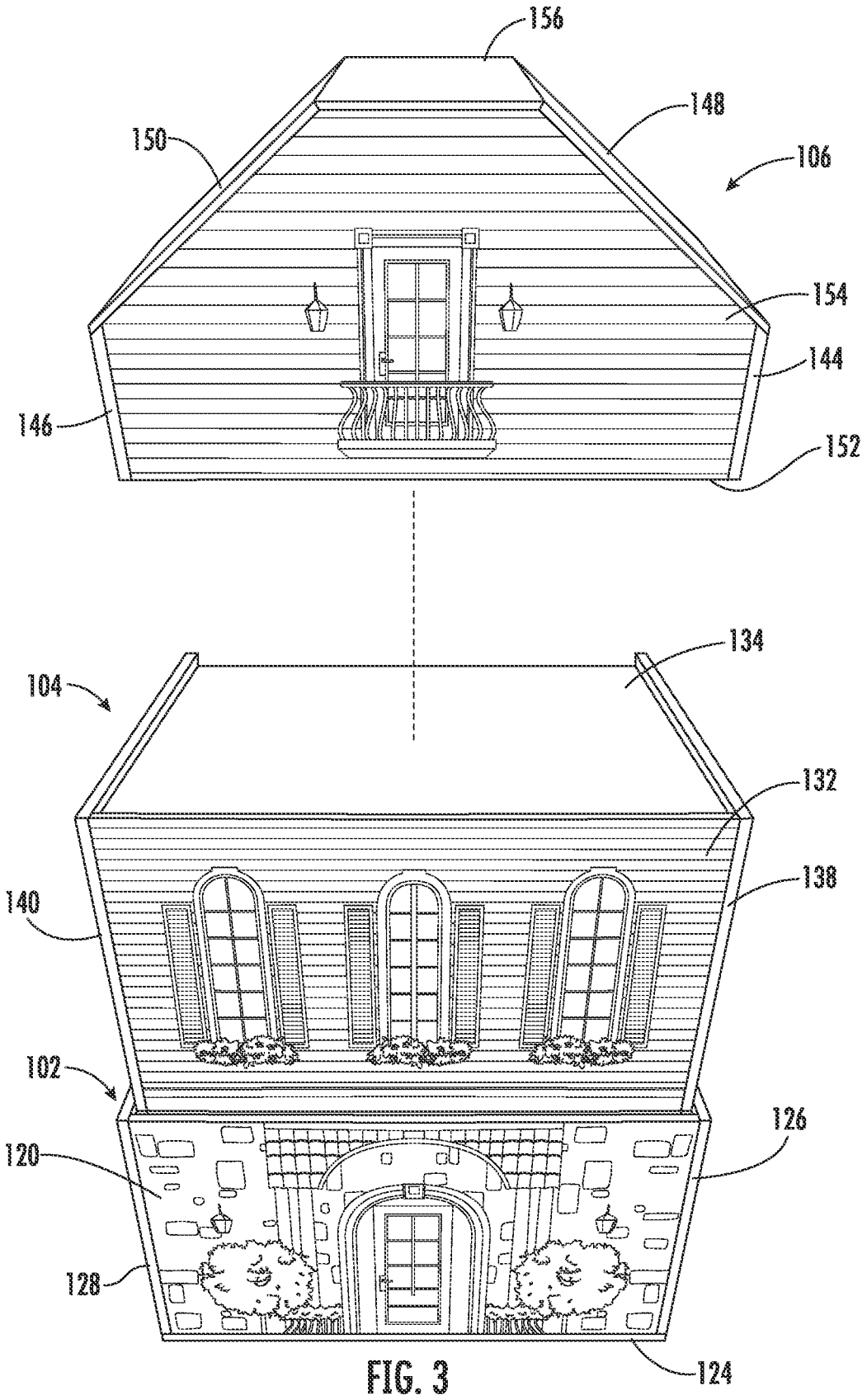
FIG. 3 is a partially-exploded rear view of a stackable nesting dollhouse in accordance with one embodiment.
Figure 15A:
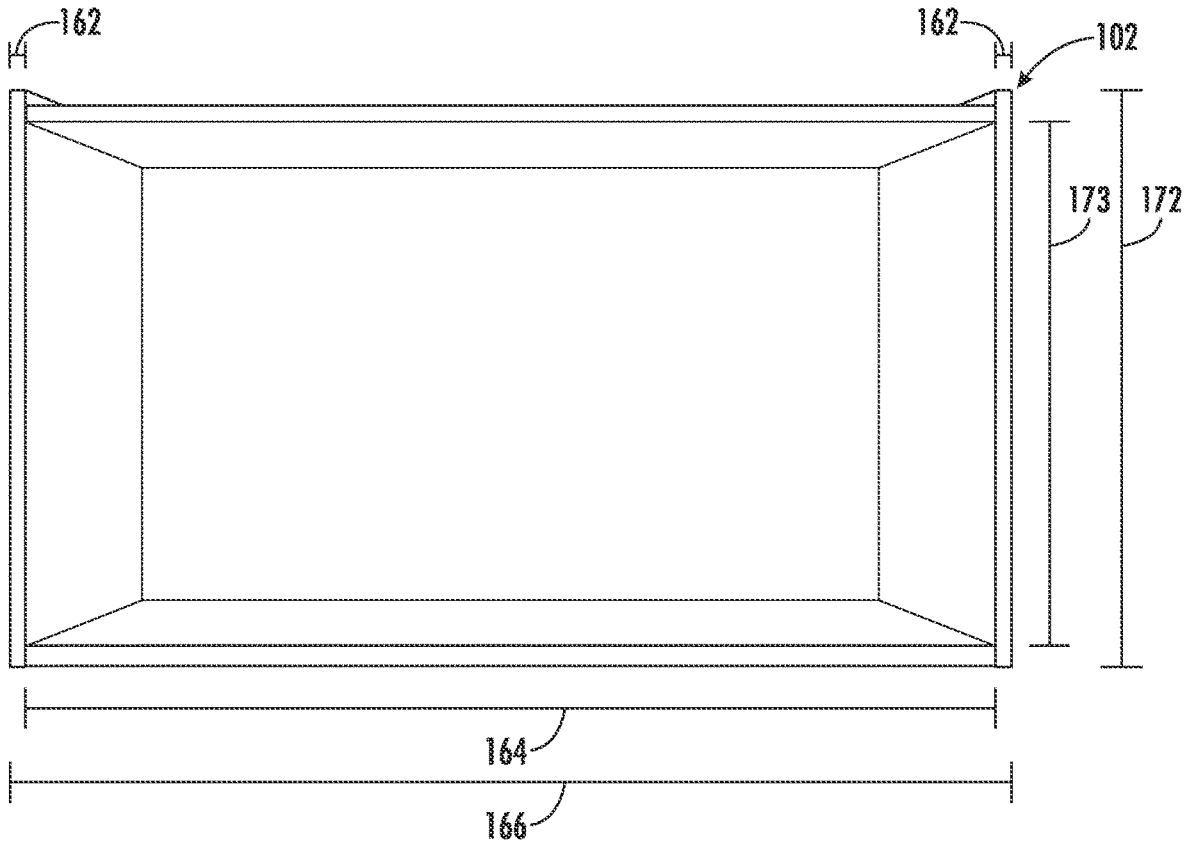
FIG. 15A is a front perspective view of a first component of a stackable nesting dollhouse, in accordance with one embodiment.

Referring now to FIG. 1, the stackable nesting dollhouse 100 is shown in an exploded view of the stacked configuration. According to one embodiment, the first component 102 may include a number of planar sidewalls extending orthogonally from a plane formed by the planar first rear wall 120. The first component 102 may include a first upper wall 122, a first lower wall 124, a first left wall 126, and a first right wall 128, wherein each of these extends orthogonally from the plane formed by the first rear wall 120. The first upper wall 122 may be located at a first offset 130 from the plane formed at the intersection of the first left wall 126, first rear wall 120, and the first right wall 128. As shown in FIGS. 1 and 15A, the first upper wall 122 may be located lower than the plane formed by the intersection of the first left wall 126, the first rear wall 120, and the first right wall 128, resulting in a first offset. In one embodiment, the first offset may be in a range of approximately one-half of an inch to two-thirds of an inch.

Figure 14A:
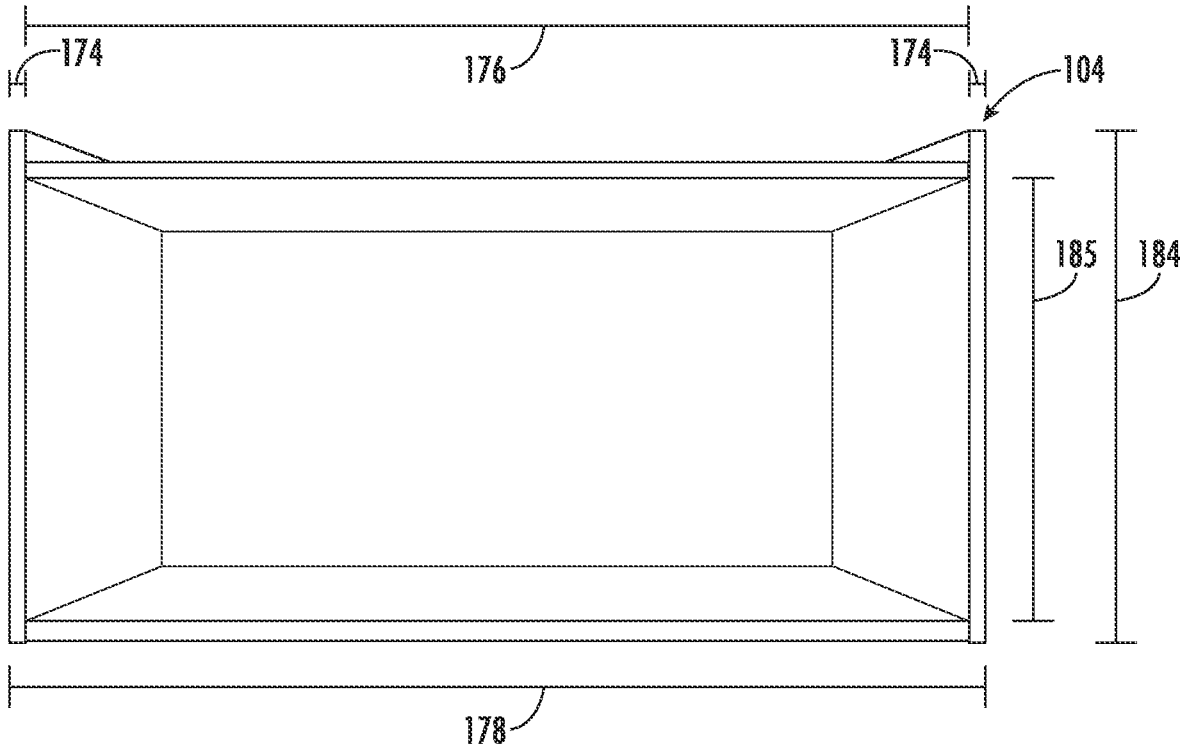
FIG. 14A is a front perspective view of a second component of a stackable nesting dollhouse, in accordance with one embodiment.

According to one embodiment, the second component 104 may include a number of planar sidewalls extending orthogonally from a plane formed by the second rear wall 132. The second component 104 may include a second upper wall 134, a second lower wall 136, a second left wall 138, and a second right wall 140. The second upper wall 134 may be located at a second offset from the plane formed at the intersection of the second left wall 138, the second rear wall 132, and the second right wall 140. As shown in FIGS. 1 and 14A, the second upper wall 134 may be located lower than the plane formed by the intersection of the second left wall 138, the second rear wall 132, and the second right wall 140, resulting in the second offset. In one embodiment, the second offset may be in a range of approximately one-half of an inch to two-thirds of an inch.

According to one embodiment, the third component 106 may include a number of planar sidewalls extending orthogonally from a plane formed by the third rear wall 154. The third component 106 may include a third upper wall 156, a third lower wall 152, a third left wall 144, third left angled wall 148, third right wall 146, and third right angled wall 150.

Figure 16:
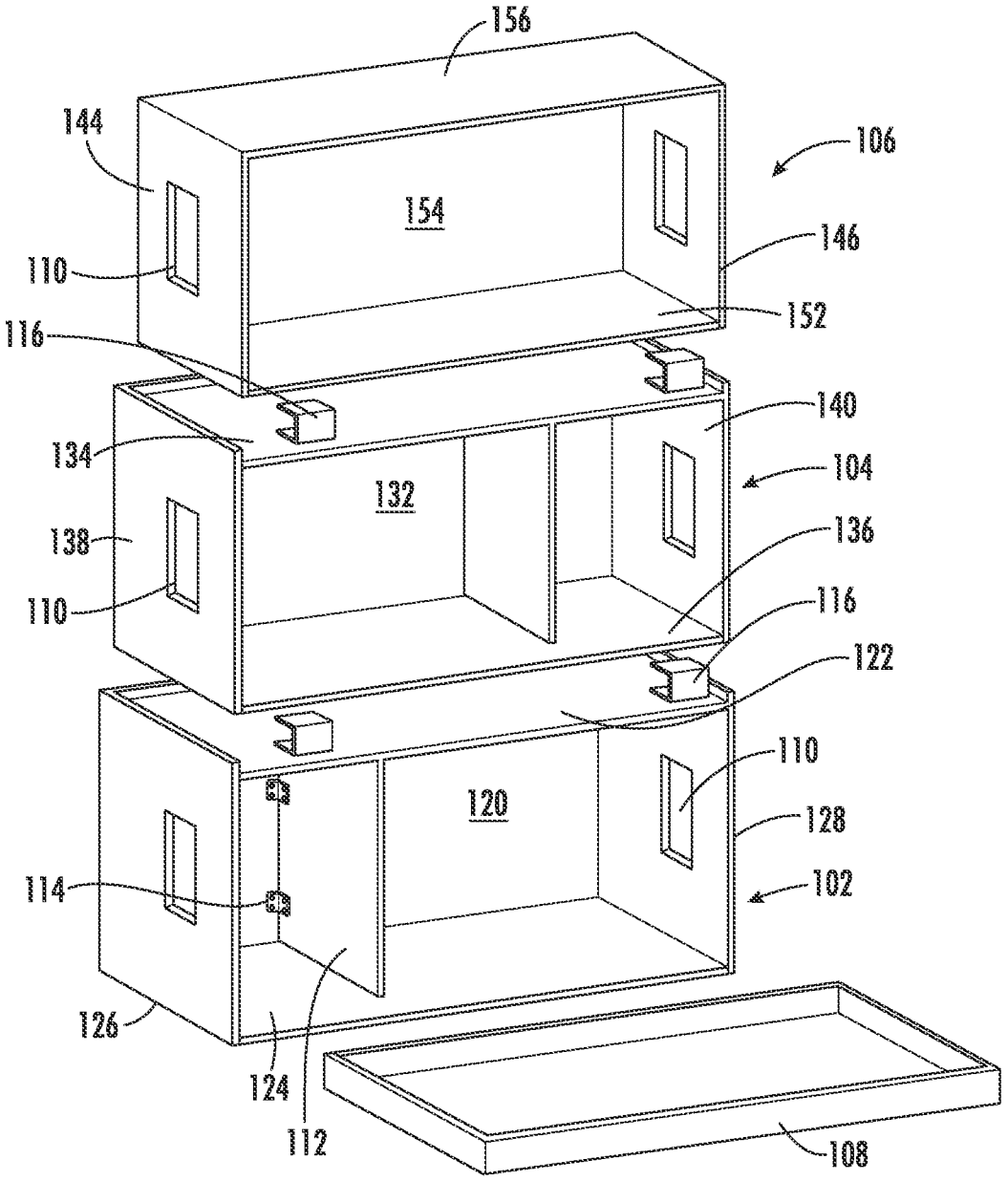
FIG. 16 is an exploded perspective view of a stackable nesting dollhouse in accordance with one embodiment.

Referring now to FIG. 16, an alternative embodiment of the stackable nesting dollhouse 100 is shown in an exploded view of the stacked configuration. According to one embodiment, the first component 102 may include a number of planar sidewalls extending orthogonally from a plane formed by a planar first rear wall 120. The first component 102 may include a first upper wall 122, a first lower wall 124, a first left wall 126, and a first right wall 128, wherein each of these extends orthogonally from the plane formed by the first rear wall 120. The first upper wall 122 may be located at an offset from the plane formed at the intersection of the first left wall 126, first rear wall 120, and the first right wall 128. The first upper wall 122 may be located lower than the plane formed by the intersection of the first left wall 126, the first rear wall 120, and the first right wall 128, resulting in a first offset. In one embodiment, the first offset may be in a range of approximately one-half of an inch to two-thirds of an inch.

According to one embodiment shown in FIG. 16, the second component 104 may include a number of planar sidewalls extending orthogonally from a plane formed by a second rear wall 132. The second component 104 may include a second upper wall 134, a second lower wall 136, a second left wall 138, and a second right wall 140. The second upper wall 134 may be located at a second offset from the plane formed at the intersection of the second left wall 138, the second rear wall 132, and the second right wall 140. The second upper wall 134 may be located lower than the plane formed by the intersection of the second let wall 138, the second rear wall 132, and the second right wall 140, resulting in a second offset. In one embodiment, the second offset may be in a range of approximately one-half of an inch to two-thirds of an inch.

According to one embodiment shown in FIG. 16, the third component 106 may include a number of planar sidewalls extending orthogonally from a plane formed by a third rear wall 154. The third component 106 may include a third lower wall 152, a third upper wall 156, third left wall 144, and a third right wall 146.

It will be appreciated by one of ordinary skill in the art that in alternative embodiments, the left, right, and/or rear walls of a component may be located between the upper wall and lower wall, and the offset may be attached to or integrated with the upper wall or lower wall of a component. For example, and in reference to an alternative embodiment of the first component 102, the first left wall 126, first rear wall 120, and first right wall 128 may be located between the first upper wall 122 and the first lower wall 124, and the offset may protrude from the first upper wall 122 as an attached piece(s) or the offset may be integrated with the upper wall 122. Alternatively, the offset may protrude from the first lower wall 124 as an attached piece(s) or the offset may be integrated with the lower wall 124. In this manner of an alternative embodiment, the first component 102's dimensions may be smaller than those of the second component 104, and the dimensions of the second component 104 may be smaller than those of the third component 106.

It will further be appreciated by one of ordinary skill in the art that the components may be stacked in a variety of configurations, in which the largest component may be seated atop the middle component, and the middle component may be seated atop the smallest component. For example, and in reference to an alternative embodiment of FIG. 1 or FIG. 16, the third component 106 may be located in the lowermost position, with either the third upper wall 156 or the third lower wall 152 oriented upward. The second component 104 may be seated atop the third component 106, with the second upper wall 134 in contact with the uppermost wall of the third component, being the third upper wall 156 or the third lower wall 152. The first component 102 may be seated atop the second component 104, with the first upper wall in contact with the second lower wall 136.

Figure 6:
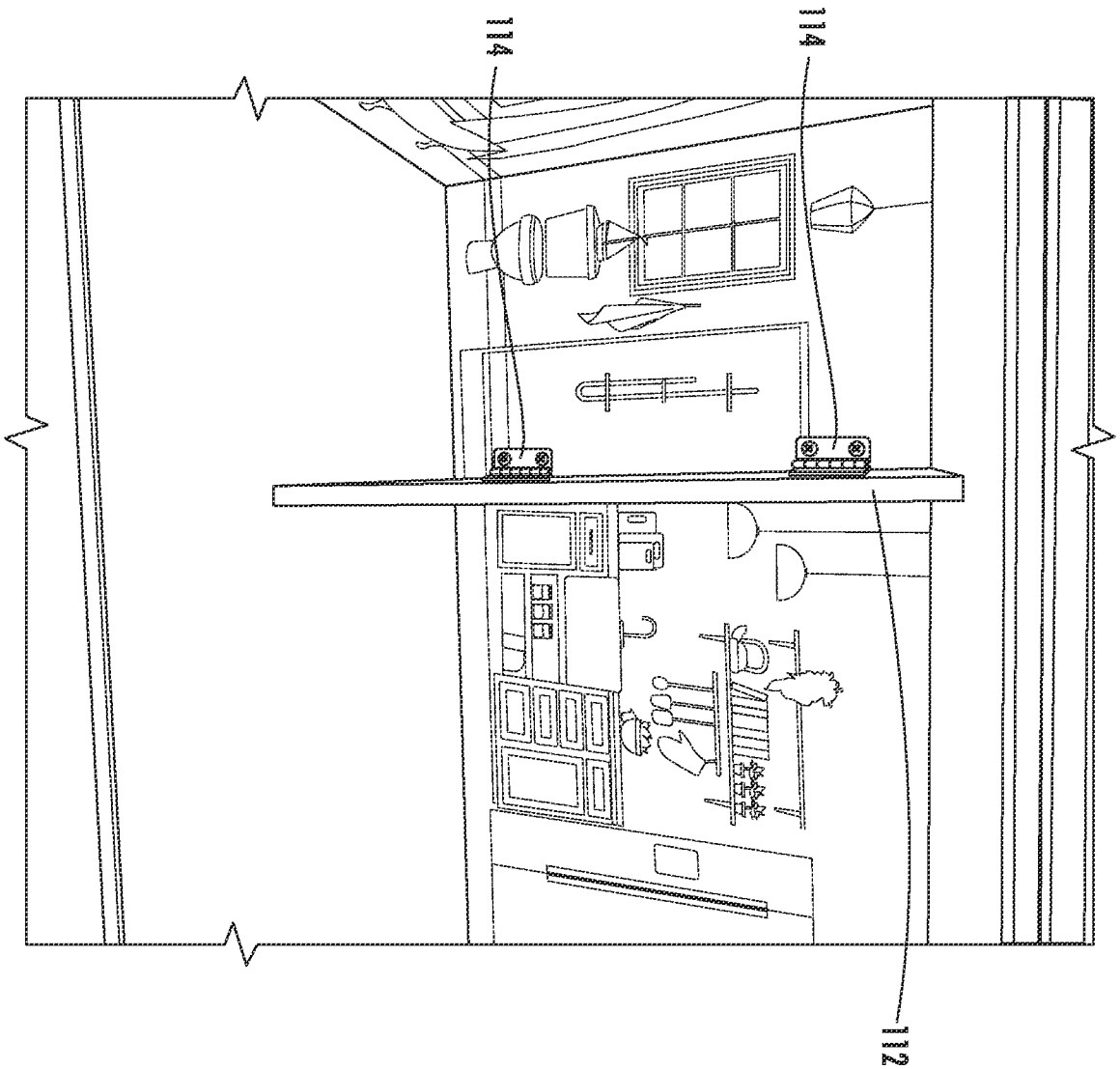
FIG. 6 is an isolated front view of a stackable nesting dollhouse, illustrating a foldable interior wall and foldable wall hinges, in accordance with one embodiment.

Referring now to FIG. 6, according to one embodiment, the first component 102 and/or the second component 104 may include at least one foldable interior wall 112. The foldable interior wall 112 may be attached by the foldable wall hinge 114 to the first rear wall 120 or the second rear wall 132 in the first component 102 and the second component 104, respectively. Additionally, or alternatively, the at least one foldable interior wall 112 may be attached to the first left wall 126, first right wall 128, second left wall 138, second right wall 140, third left wall 144, and/or third right wall 146.

Figure 15B:
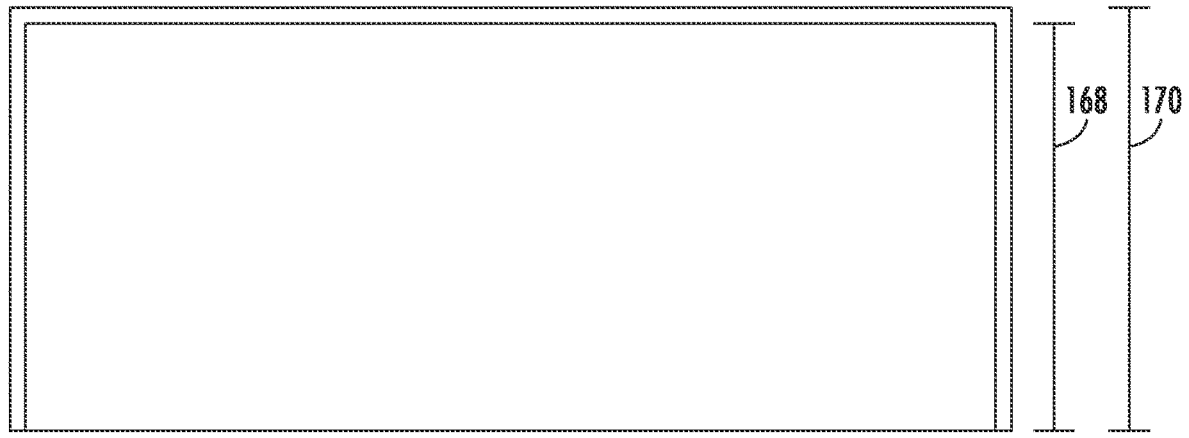
FIG. 15B is a top view of a first component of a stackable nesting dollhouse in accordance with one embodiment.

As shown in FIGS. 15A and 15B, the first component 102 may have a total length (TL1) 166, total height (TH1) 172, and total width (TW1) 170. The first component 102 may also have interior dimensions of length (L1) 164, height (H1) 173, and width (W1) 168.

Figure 14B:
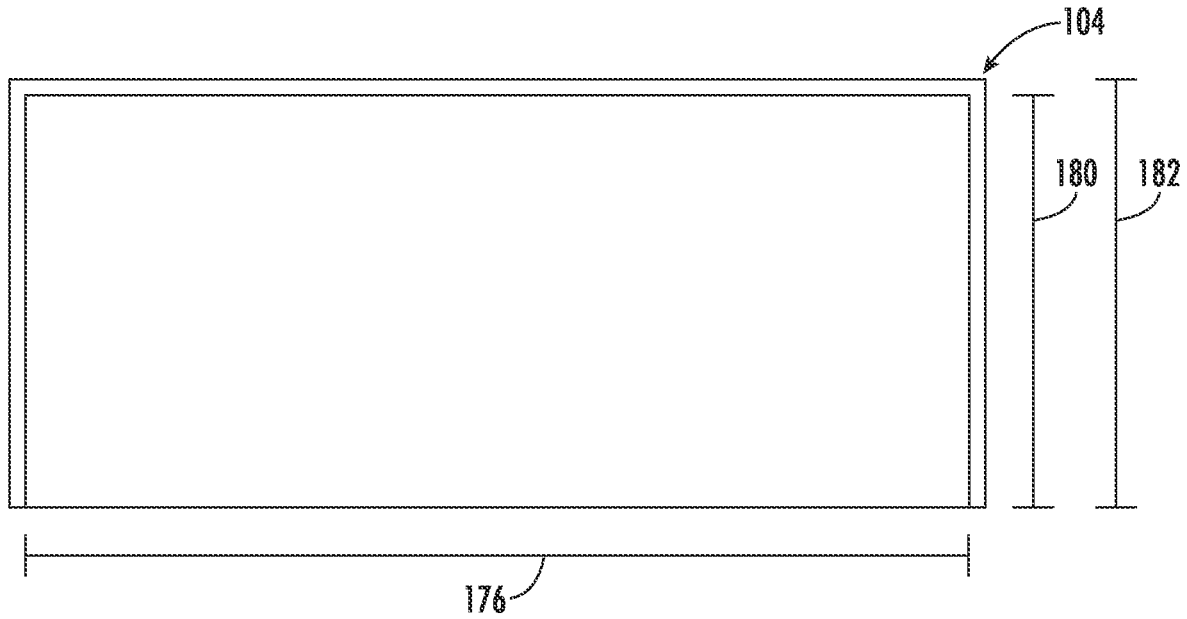
FIG. 14B is a top view of a second component of a stackable nesting dollhouse, in accordance with one embodiment.

As shown in FIGS. 14A and 14B, the second component 104 may have a total length (TL2) 178, total height (TH2) 184, and a total width (TW2) 182. The second component 104 may also have interior dimensions of length (L2) 176, height (H2) 185, and width (W2) 180.

As shown in FIGS. 13A, 13B, 18616A, and 16B, the third component 106 may have a total length (TL3) 188, a total height (TH3).

According to one embodiment, as shown in FIGS. 1 and 15A, for example, the first component 102 includes the first upper wall 122, the first rear wall 120, and the first lower wall 124, wherein the first lower wall 124 has a wall length (L1) 164. The first left wall 126 and the first right wall 128 each have a thickness (T1) 162. The first component may thus have a first component total length (TL1) 166 that can be expressed by the formula TL1=L1+T1+T1.

Similarly, the first component 102 includes the first left wall 126 and the first right wall 128. The first component has a total width 170 and a width 168. The first rear wall 120 has a first rear wall thickness (FRWT) that can be expressed by the formula FRWT=TW1−W1.

As shown in FIGS. 1 and 14A, for example, the second component 104 includes the second rear wall 132, the second upper wall 134, and the second lower wall 136, wherein the second lower wall 136 has a wall length (L2). The second left wall 138 and the second right wall 140 each have a second wall thickness 174 (T2). The second component may thus have a second component total length 178 (TL2) that can be expressed by the formula TL2=L2+T2+T2.

Similarly, the second component 104 includes a second left wall 138 and a second right wall 140. The second rear wall 132 has a second rear wall depth (SRWD) that can be expressed by the formula SRWD=TW2−W2.

Figure 12:
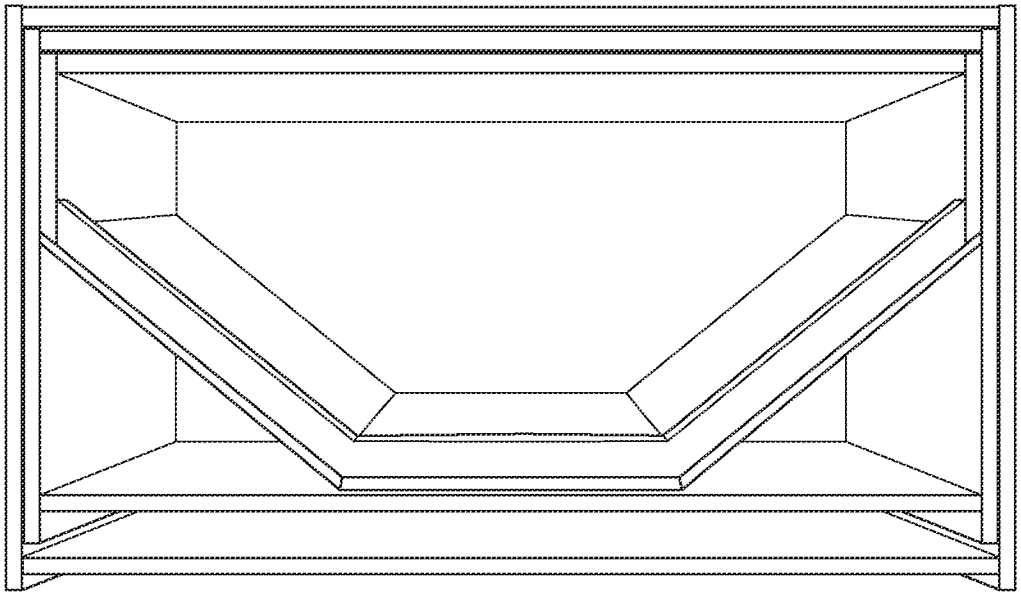
FIG. 12 is a front view of a stackable nesting dollhouse, illustrating the stackable nesting dollhouse in the nested configuration.

According to one embodiment, the second component 104 is sized to be stored inside the first component 102 in a nested configuration, as illustrated in FIG. 12. To facilitate this nested configuration, the second component 104 is dimensioned in relation to the first component 102 such that TH2 is less than or approximately equal to H1, TL2 is less than or approximately equal to L1, and TW2 is less than or approximately equal to W1.

According to one embodiment, the second component is sized to be seated atop the first component 102 in a stacked configuration, wherein the second lower wall 136 may be in contact with the first upper wall 122. To facilitate this stacked configuration, the second component 104 is dimensioned in relation to the first component 102 such that TW2 is less than or approximately equal to W1 and TL2 is less than or approximately equal to L1.

Figure 13A:
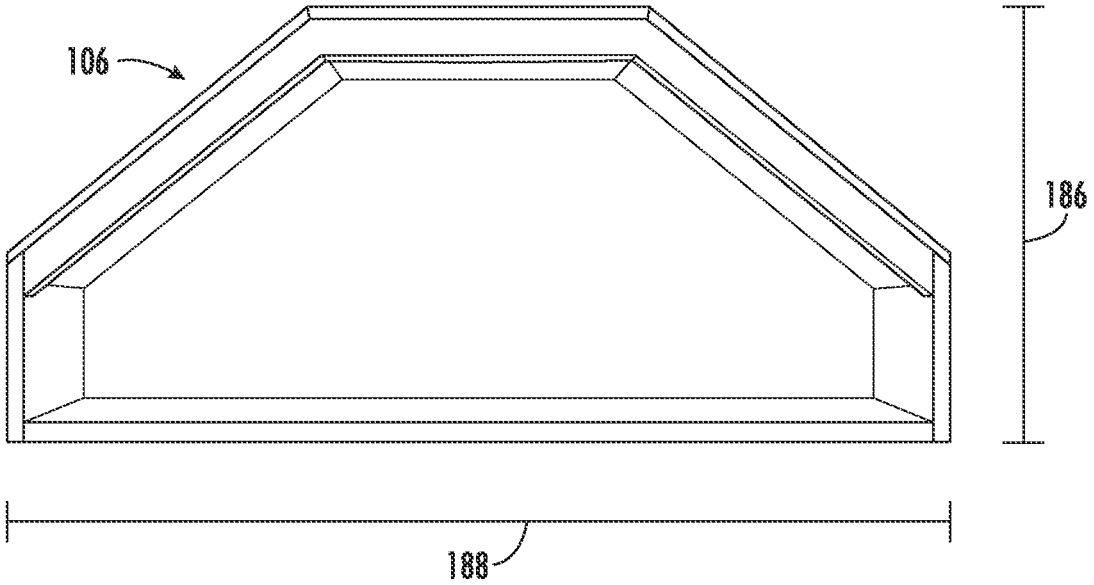
FIG. 13A is a front perspective view of a third component of a stackable nesting dollhouse, in accordance with one embodiment.
Figure 13B:
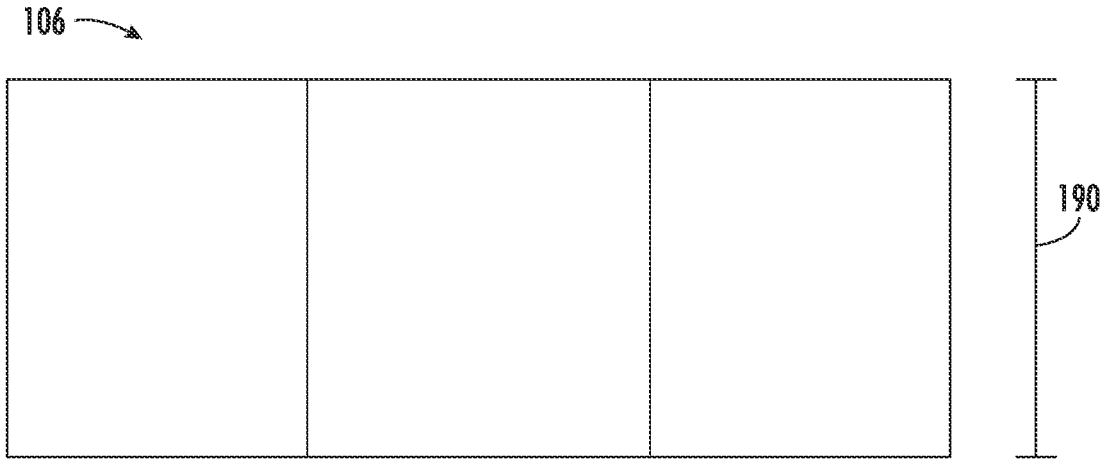
FIG. 13B is a top view of a third component of a stackable nesting dollhouse, in accordance with one embodiment.

According to one embodiment, the third component 106 may include a number of planar sidewalls 118 extending orthogonally from a third rear wall 154. As shown in FIGS. 1, 13A, and 13B, for example, the third component 106 includes a third lower wall 152, a third left wall 144, a third left angled wall 148 extending upwards and inward from the third left wall 144, a third right wall 146, a third right angled wall 150 extending upwards and inward from the third right wall 146, a third upper wall 156 extending approximately horizontally between the third left angled wall 148 and the third right angled wall 150, and a third rear wall 154.

The third component has a width (W3) 190, a height (H3) 186, and a length (L3) 188. According to one embodiment, the third component is sized to be seated atop the second component 104 in a stacked configuration, wherein the third lower wall 152 may be in contact with the second upper wall 134. To facilitate this stacked configuration, the third component 106 is dimensioned in relation to the second component 104 such that L3 is less than or approximately equal to L2, and W3 is less than or approximately equal to W2.

According to one embodiment, the third component 106 is sized to be nested inside the second component 104, which in turn, may be nested inside the first component 102 in a nested configuration, as illustrated in FIG. 12. To facilitate this nested configuration, the third component 106 is dimensioned in relation to the second component 104 such that H3 is less than or approximately equal to T2, W3 is less than or approximately equal to W2, and L3 is less than or approximately equal to L2.

Figure 5:
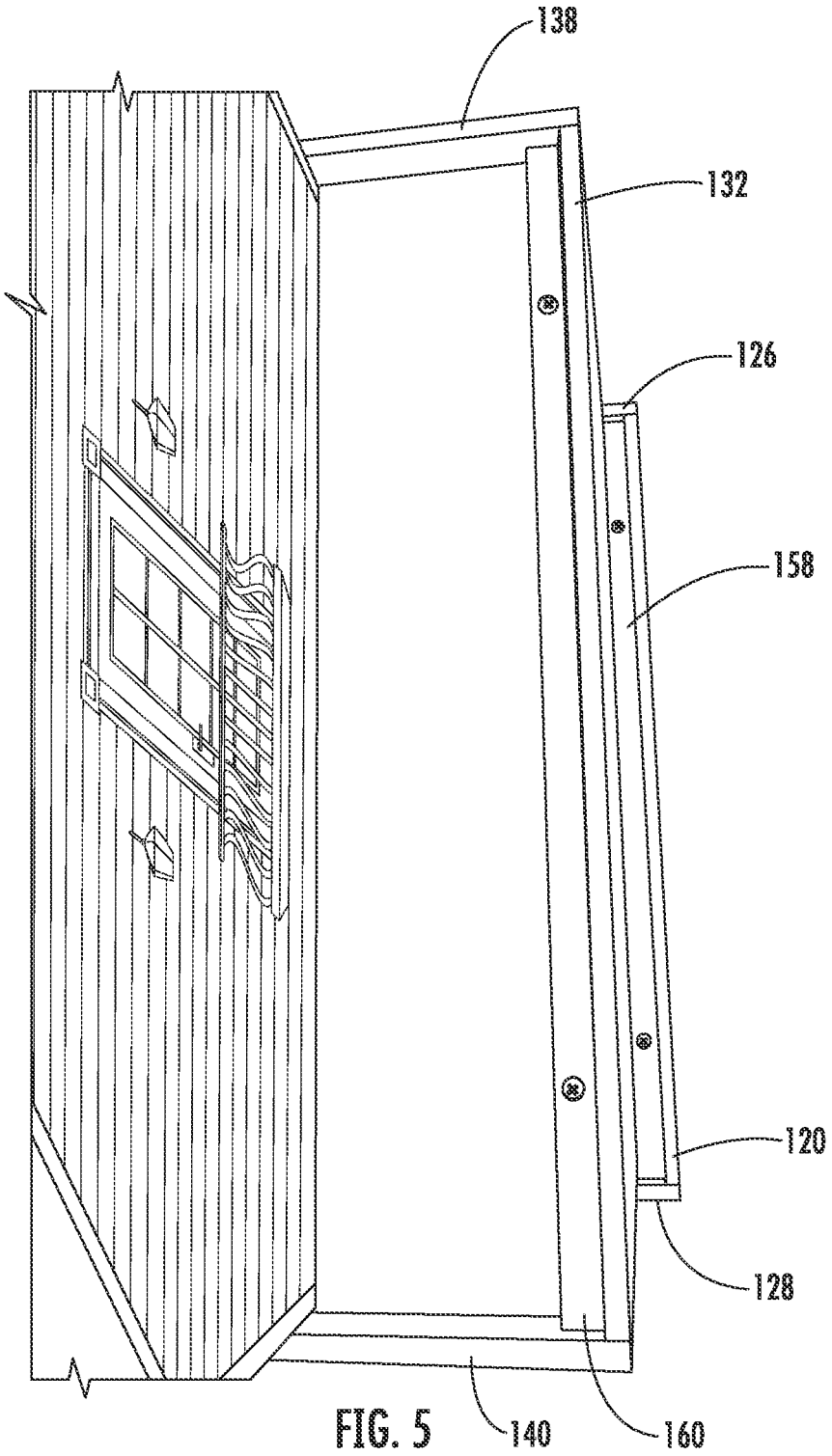
FIG. 5 is an isolated overhead view of a stackable nesting dollhouse, illustrating a third component in the process of being seatedatop a second component and a second component seated atop a first component, in accordance with one embodiment.

Referring now to FIG. 5, an isolated overhead view of a stackable nesting dollhouse 100 is shown, illustrating a third component 106 in the process of being seated atop a second component 104 and a second component 104 seated atop a first component 102, in accordance with one embodiment. As shown in FIGS. 4 and 1, for example, the third component 106 may be configured with the third rear wall 154 fully seated against the second spacer 160. Alternatively, in the absence of the second spacer 160, the third component 106 may be configured with the third rear wall 154 fully seated against the second rear wall 132.

According to one embodiment, the second component 104 may include a second spacer 160 located adjacent to the second rear wall 132, wherein the second spacer 160 may provide a surface against which the third component 106 may be seated when in the stacked configuration. Similarly, the first component 102 may include a first spacer 158 located adjacent to the first rear wall 120, wherein the first spacer 158 may provide a surface against which the second component 104 may be seated when in the stacked configuration.

Referring now to FIGS. 1-4, the relational dimensionality of the first component 102, second component 104, and third component 106 can be seen in the stacked configuration, where the second component 104 is configured to be seated atop the first component 102, and the third component 106 is configured to be seated atop the first component 102. This same relational dimensionality permits the nested configuration of the stackable nesting dollhouse 100, wherein the third component 106 may be nested inside the second component 104, and the second component 104 in turn, may be nested inside the first component 102, as shown in FIG. 12.

It will be appreciated by one of ordinary skill in the art that the stackable nesting dollhouse 100 may contain more than three components configured to be stacked atop one another and nested within one another, wherein the first component may be represented by $C_{First}$, intermediate components may be represented by $C_n$, and the uppermost stacked/innermost nested component may be represented by $C_{Final}$, wherein n is an integer greater than one. In such a configuration, for example, $C_{First}$ would have interior length (L-first), interior height (H-first), interior width (W-first), exterior length (TL-first), exterior height (TH-first), and exterior width (W-first), where such measurements would correspond to the measurements of the first component 102, as referenced above. Intermediate components $C_n$, for example, would have, for example, interior length (Ln), interior height (Hn), interior width (Wn), exterior length (TLn), exterior height (THn), and exterior width (Wn). The uppermost stacked/innermost nested component, $C_{Final}$, would have, for example, a width (W-final), a height (H-final), and a length (L-final). The additional component(s) ($C_n$) would have a dimensional relationship such that the above-listed measurements for $C_n$ would be greater than or approximately equal to those corresponding dimensions for $C_{n+1}$. Similarly, the additional components would have a dimensional relationship such that the above-listed measurements for $C_n$ would be less than or approximately equal to those corresponding dimensions for $C_{n-1}$. The uppermost intermediate component in the stacked configuration, $C_{nMAX}$, would, for example, be sized such that its dimensions are greater than or approximately equal to those corresponding dimensions of $CF_{inal}$.

Referring now to FIG. 6, an isolated front view of a stackable nesting dollhouse 100 is shown, illustrating a foldable interior wall 112 and foldable wall hinges 114, in accordance with one embodiment. According to one embodiment, the first component 102 may contain at least one foldable interior wall 112 and the second component may also contain at least one foldable interior wall 112, wherein the foldable interior wall 112 of the first component 102 may have a height approximately equal to H1 173 and the foldable interior wall 112 of the second component may have a height approximately equal to H2 185. In the nested configuration, a foldable interior wall 112 may be folded inward against the first rear wall 120 of the first component 102 or against the second rear wall 132 of the second component 104, respectively. In the stacked configuration, the at least one foldable interior wall 112 of the first component 102, for example, may be unfolded perpendicular to the first rear wall 120, wherein the foldable interior wall 112 is in contact with the first lower wall 124 and the first upper wall 122, thus providing support to the first upper wall 122. Similarly, in the stacked configuration, the at least one foldable interior wall 112 of the second component 104, for example, may be unfolded perpendicular to the second rear wall 132, wherein the foldable interior wall 112 is in contact with the second lower wall 136 and the second upper wall 134, thus providing support to the second upper wall 134.

According to one embodiment, the foldable interior wall 112 may be of a height less than that of the interior height of the component in which the foldable interior wall 112 is positioned. For example, with respect to the first component 102, the foldable interior wall 112 may be of a height less than H1 173 and the foldable interior wall 112 of the second component 104 may be of a height less than H2 185. The foldable interior wall 112 may similarly have a thickness less than or substantially equal to the thickness of the respective wall of the component in which the respective foldable interior wall 112 is positioned. For example, with respect to the first component 102, the foldable interior wall 112 may be of a thickness less than or substantially equal to the first lower wall 124, first left wall 126, first upper wall 122, and/or first right wall 128.

Figure 11:
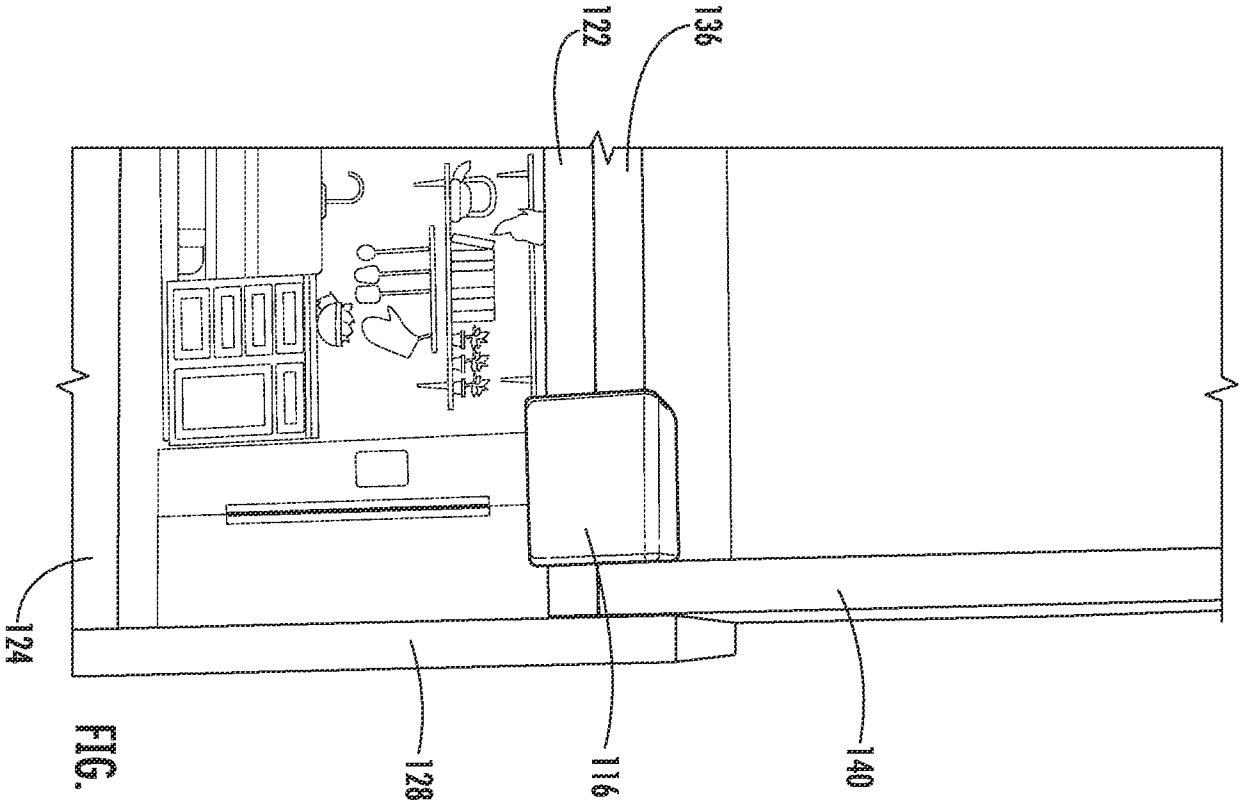
FIG. 11 is an isolated front view of a stackable nesting dollhouse, illustrating a second component stackably secured atop a first component via stacking clip, in accordance with one embodiment.

Referring now to FIG. 11, an isolated front view of a stackable nesting dollhouse 100 is shown, illustrating a second component 104 stackably secured atop a first component 102 via a stacking clip 116. It will be appreciated by one of ordinary skill in the art that the first component 102, second component 104, and/or third component 106 (and any additional components) may include apertures along the side and/or rear walls, wherein the apertures are capable of alignment between the components. This alignment permits passage of the stacking clips 116 through the side and/or rear component walls in order to secure the components in the stacked configuration. Similarly, the apertures may be spaced sufficiently apart such that the apertures are sized and positioned to receive the arms of the stacking clip 116. By way of non-limiting example, the first component 102 may have apertures located on the first rear wall 120, first left wall 126, and/or first right wall 128, and the second component 104 may have apertures located on a lower portion of the second rear wall 132, second left wall 138, or second right wall 140, wherein the respective apertures of the first component 102 and second component 104 are in alignment for receipt of the respective stacking clip 116 arms when securing the second component 104 as seated atop the first component 102.

According to additional embodiments, the clip 116 or the attachment means for adjacent components may additionally or alternatively be composed of a latch, a bolt and receiver, snap and receiver, hook and loop, or magnets. According to one embodiment, the components may be attached to one another through complementary joints, where, for example, a positive feature may be seated into a negative space for means of attaching adjacent components to one another.

Figure 7:
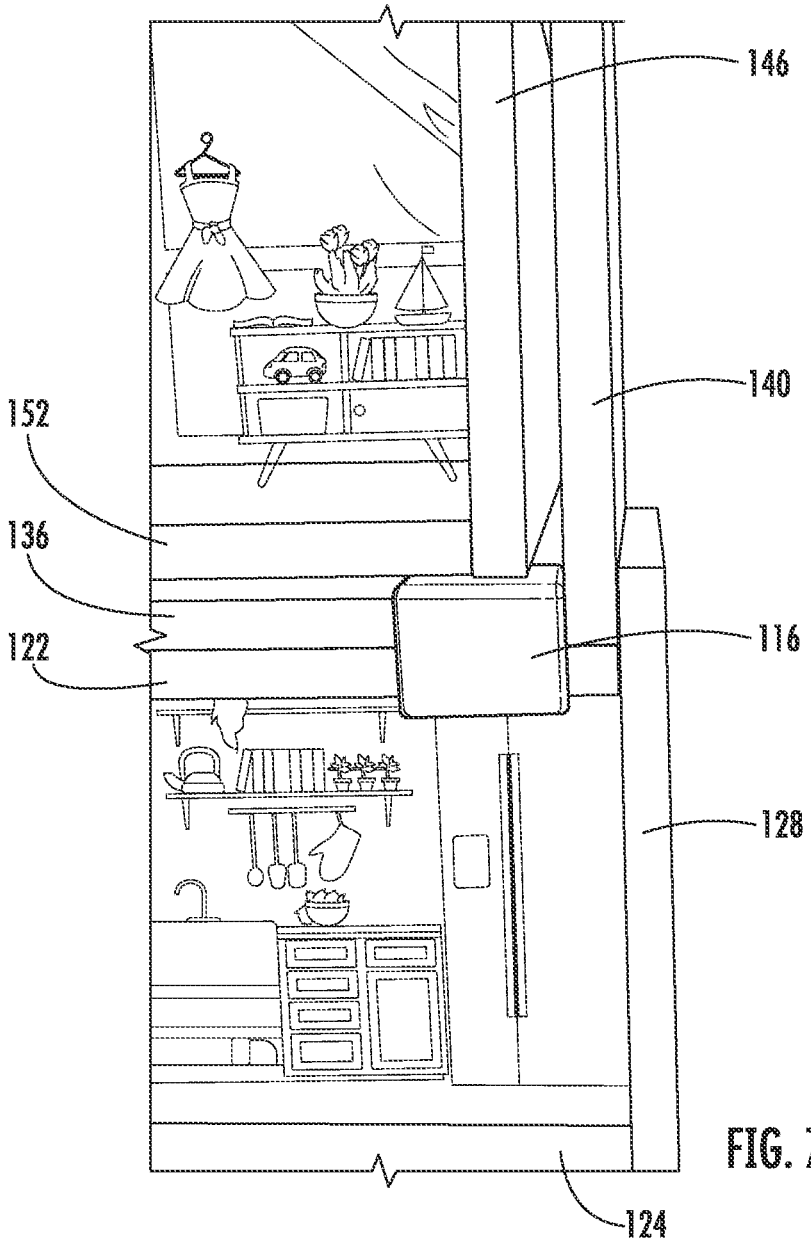
FIG. 7 is an isolated front view of a stackable nesting dollhouse, illustrating a second component stackably secured atop a first component via stacking clip and a third component nested inside a second component, according to one embodiment.

Referring now to FIG. 7, an isolated front view of a stackable nesting dollhouse 100 is shown, illustrating a second component 104 stackably secured atop a first component 102 via stacking clip 116 and a third component 106 nested inside the second component 104, according to one embodiment.

Figure 8:
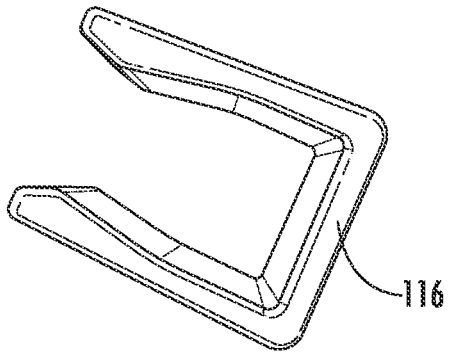
FIG. 8 is a profile view of a stacking clip, in accordance with one embodiment.

As shown in FIG. 8, the stacking clip 116 may be configured in a "C-shaped" configuration, with the arms of the "C-shape" biased acutely towards the interior center of the "C-shape," thus providing a compressive force for gripping components located within the negative interior space within the "C-shape." This compressive force may be seen in FIGS. 7 and 11 where the stacking clip 116 is utilized to secure the second lower wall 136 and the first upper wall 122 together in the stacked configuration. According to one embodiment, the arms of the "C-shape" of the stacking clip 116 may have a degree of flexion to allow the arms to be moved away from the center of the "C-shape" when the stacking clip 116 is being secured around two components, while providing a compressive force when in static securement around the components. The stacking clip 116 may be formed of plastic, metal, or a similarly flexible, yet sturdy material.

Referring now to FIG. 12, the stackable nesting dollhouse 100 is shown in the nested configuration, wherein the third component 106 is shown nested inside the second component 104, and the second component 104 is shown nested inside the first component 102.

Figure 9:
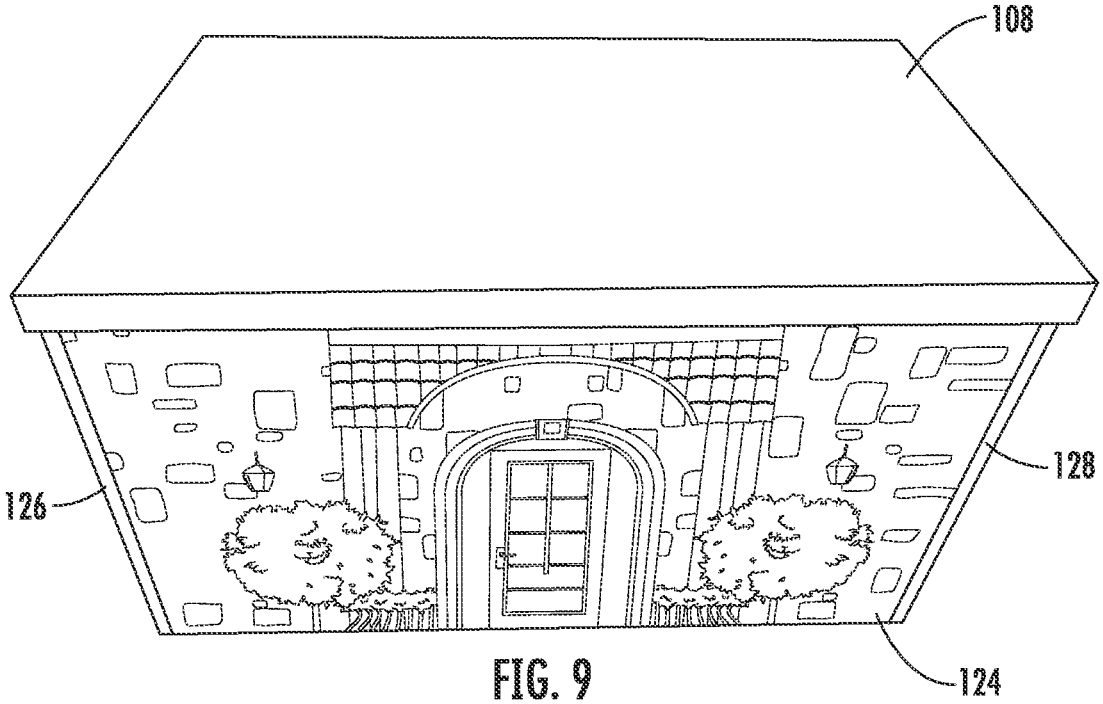
FIG. 9 is a perspective view of a stackable nesting dollhouse in a nested configuration, in accordance with one embodiment.
Figure 10:
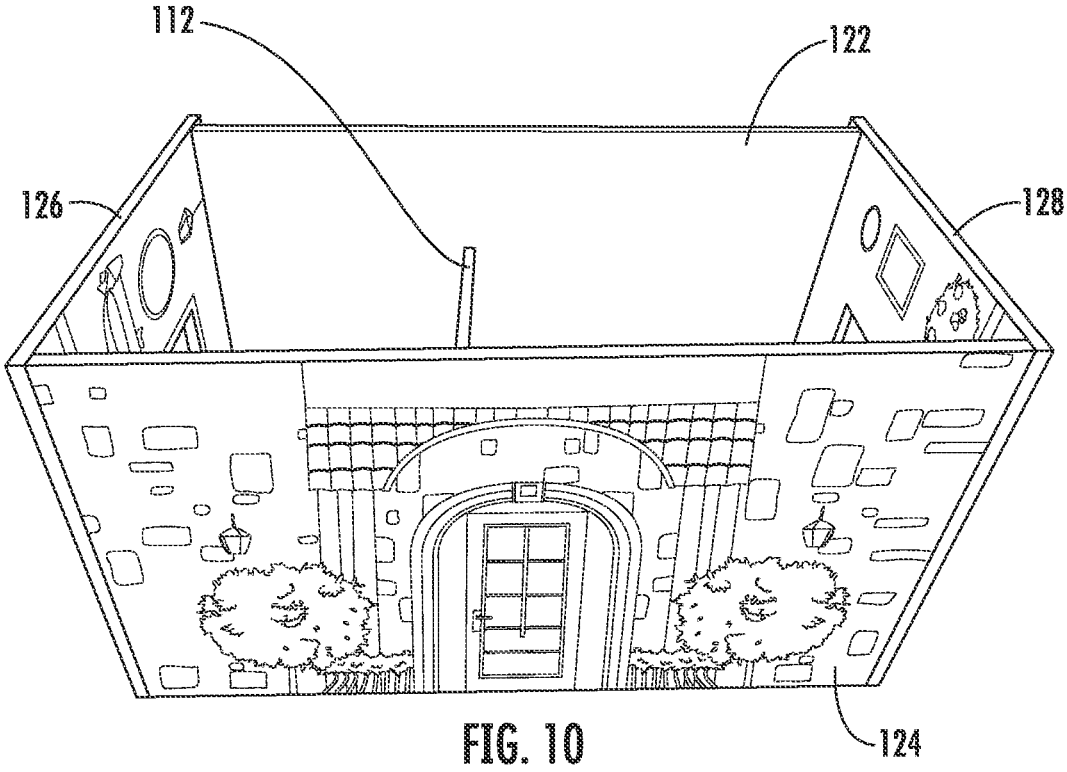
FIG. 10 is a bottom view of a first component of a stackable nesting dollhouse, in accordance with one embodiment.

Referring now to FIG. 9, the stackable nesting dollhouse 100 is shown in the nested configuration, with the nesting lid 108 seated atop the first component 102, covering the opening created by the first upper wall 122, first left wall 126, first lower wall 124, and first right wall 128.

While the present invention has been shown and described in accordance with several preferred and practical embodiments, it is recognized that departures from the instant disclosure are contemplated within the spirit and scope of the present invention.

Unless otherwise defined, all terms (including technical and scientific terms) used herein have the same meaning as commonly understood by one of ordinary skill in the art to which this subject matter belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. For brevity and/or clarity, well-known functions or constructions may not be described in detail herein.

The term "exemplary" is used herein to mean serving as an example, instance, or illustration. Any aspect or design described herein as "exemplary" is not necessarily to be construed as preferred or advantageous over other aspects or designs. Similarly, examples are provided herein solely for purposes of clarity and understanding and are not meant to limit the subject innovation or portion thereof in any manner.

The terms "for example" and "such as" mean "by way of example and not of limitation." The subject matter described herein is provided by way of illustration for the purposes of teaching, suggesting, and describing, and not limiting or restricting. Combinations and alternatives to the illustrated embodiments are contemplated, described herein, and set forth in the claims.

For convenience of discussion herein, when there is more than one of a component, that component may be referred to herein either collectively or singularly by the singular reference numeral unless expressly stated otherwise or the context clearly indicates otherwise. For example, components N (plural) or component N (singular) may be used unless a specific component is intended. Also, the singular forms "a," "an," and "the" are intended to include the plural forms as well, unless expressly stated otherwise or the context indicates otherwise.

It will be further understood that the terms "includes," "comprises," "including," and/or "comprising" specify the presence of stated features, steps, operations, elements, and/or components, but do not preclude the presence or addition of one or more other features, steps, operations, elements, components, and/or groups thereof unless explicitly stated otherwise or the context clearly requires otherwise. The terms "includes," "has" or "having" or variations in form thereof are intended to be inclusive in a manner similar to the term "comprises" as that term is interpreted when employed as a transitional word in a claim.

It will be understood that when a component is referred to as being "connected" or "coupled" to another component, it can be directly connected or coupled or coupled by one or more intervening components unless expressly stated otherwise or the context clearly indicates otherwise.

The term "and/or" includes any and all combinations of one or more of the associated listed items. As used herein, phrases such as "between X and Y" and "between about X and Y" should be interpreted to include X and Y unless expressly stated otherwise or the context clearly indicates otherwise.

Terms such as "about", "approximately", and "substantially" are relative terms and indicate that, although two values may not be identical, their difference is such that the apparatus or method still provides the indicated or desired result, or that the operation of a device or method is not adversely affected to the point where it cannot perform its intended purpose. As an example, and not as a limitation, if a height of "approximately X inches" is recited, a lower or higher height is still "approximately X inches" if the desired function can still be performed or the desired result can still be achieved.

While the terms vertical, horizontal, upper, lower, bottom, top, and the like may be used herein, it is to be understood that these terms are used for ease in referencing the drawing and, unless otherwise indicated or required by context, does not denote a required orientation.

The different advantages and benefits disclosed and/or provided by the implementation(s) disclosed herein may be used individually or in combination with one, some or possibly even all of the other benefits. Furthermore, not every implementation, nor every component of an implementation, is necessarily required to obtain, or necessarily required to provide, one or more of the advantages and benefits of the implementation.

Conditional language, such as, among others, "can", "could", "might", or "may", unless specifically stated otherwise, or otherwise understood within the context as used, is generally intended to convey that certain embodiments preferably or optionally include certain features, elements and/or steps, while some other embodiments optionally do not include those certain features, elements and/or steps. Thus, such conditional language indicates, in general, that those features, elements and/or step may not be required for every implementation or embodiment.

The subject matter described herein is provided by way of illustration only and should not be construed as limiting the nature and scope of the subject invention. While examples of aspects of the subject invention have been provided above, it is not possible to describe every conceivable combination of components or methodologies for implementing the subject invention, and one of ordinary skill in the art may recognize that further combinations and permutations of the subject invention are possible. Furthermore, the subject invention is not necessarily limited to implementations that solve any or all disadvantages which may have been noted in any part of this disclosure. Various modifications and changes may be made to the subject invention described herein without following, or departing from the spirit and scope of, the exemplary embodiments and applications illustrated and described herein.

Although the subject matter presented herein has been described in language specific to components used therein, it is to be understood that the subject invention is not necessarily limited to the specific components or characteristics thereof described herein; rather, the specific components and characteristics thereof are disclosed as example forms of implementing the subject invention. Accordingly, the disclosed subject matter is intended to embrace all alterations, modifications, and variations, that fall within the scope and spirit of any claims included herein or that may be written.

The foregoing Detailed Description is intended only to convey to a person having ordinary skill in the art the fundamental aspects of the disclosed subject matter and is not intended to limit, and should not be construed as limiting, the scope of any claims. Further, in the foregoing Detailed Description, various features may be grouped together in a single embodiment or implementation for the purpose of streamlining the disclosure. This method of disclosure is not to be interpreted as reflecting an intention that a claimed embodiment, implementation, or application requires more features than are expressly recited in a claim. Rather, claims reflect patentable subject matter which may lie in less than all features of a single disclosed embodiment, implementation, or application. Thus, all claims which may be present herein are hereby incorporated into the Detailed Description, with each claim standing on its own as a separate embodiment, implementation, or application.

The invention claimed is:

1. A stackable nesting dollhouse comprising:

a first component, a second component, and a third component;

the first component includes a plurality of first planar sidewalls extending orthogonally from a plane formed by a first planar rear wall, wherein the plurality of first planar side walls include a first upper wall, a first lower wall, a first left wall, and a first right wall, wherein the first upper wall may be located lower than the plane formed by the intersection of the plane of the first left wall, the plane of the first rear wall, and the plane of the first right wall, resulting in a first offset;

the second component includes a plurality of second planar sidewalls extending orthogonally from a plane formed by a second planar rear wall, wherein the plurality of second planar sidewalls include a second upper wall, a second lower wall, a second left wall, and a second right wall, wherein the second upper wall may be located lower than the plane formed by the intersection of the plane of the second left wall, the plane of the second rear wall, and the plane of the second right wall, resulting in a second offset;

the third component includes a plurality of third planar sidewalls extending orthogonally from a plane formed by a third planar rear wall, wherein the plurality of third planar sidewalls includes a third left wall, third right wall, third left angled wall, third right angled wall, third lower wall, and third upper wall;

the first component having an interior length (L1), an interior height (H1), an interior width (W1), an exterior length (TL1), an exterior height (TH1), and an exterior width (TW1);

the second component having an interior length (L2), an interior height (H2), an interior width (W2), an exterior length (TL2), an exterior height (TH2), and an exterior width (TW2);

the third component having an exterior length (L3), an exterior height (H3), and an exterior width (W3);

the first component and the second component having a defined dimensional relationship, the defined dimensional relationship being: TL2 is less than or approximately equal to L1; TH2 is less than or approximately equal to H1; and TW2 is less than or approximately equal to W2; and the second component and the third component having a defined dimensional relationship, the defined dimensional relationship being: L3 is less than or approximately equal to L2; H3 is less than or approximately equal to H2; and W3 is less than or approximately equal to W2.

2. A stackable nesting dollhouse comprising:

a first component ($C_{First}$), a plurality of intermediate components ($C_n$), and a final component ($C_{Final}$), wherein the intermediate components are sized to nest within one another and within the first component, and the final component being sized to nest within the intermediate components;

the first component ($C_{First}$) including a plurality of first planar sidewalls extending orthogonally from a plane formed by the first planar rear wall, wherein the plurality of first planar side walls includes a first upper wall, a first lower wall, a first left wall, and a first right wall, wherein the first upper wall is located lower than the plane formed by the intersection of the plane of the first left wall, the plane of the first rear wall, and the plane of the first right wall, resulting in a first offset;

the intermediate components ($C_n$) each including a plurality of n-planar sidewalls, including a n-upper wall, a n-lower wall, a n-left wall, and a n-right wall, wherein the n-upper wall is located lower than the plane formed by the intersection of the plane of the n-left wall, the plane of the n-rear wall, and the plane of the n-right wall, resulting in a n-offset;

the first component ($C_{First}$) having an interior length (L-First), an interior height (H-First), an interior width (W-First), an exterior length (TL-First), an exterior height (TH-First), and an exterior width (TW-First);

the intermediate components, $C_n$, having $C_n$ dimensions including an interior length (Ln), an interior height (Hn), an interior width (Wn), an exterior length (TLn), an exterior height (THn), and an exterior width (TWn);

the final component, $C_{Final}$, having a width (W-Final), a height (H-Final), and a length (L-Final); and the intermediate components, $C_n$, having a dimensional relationship such that each $C_n$ dimension is greater than or approximately equal to each corresponding dimension for $C_{n+1}$, and the intermediate components, $C_n$, further having a dimensional relationship such that each $C_n$ dimension is less than or approximately equal to each corresponding dimension for $C_{n-1}$.

* * * * *